US008091595B2

(12) United States Patent
Windrich

(10) Patent No.: US 8,091,595 B2
(45) Date of Patent: Jan. 10, 2012

(54) WOOD SPLITTER

(75) Inventor: Wolfgang Windrich, Ichenhausen (DE)

(73) Assignee: Sheppach Fabrikation von Holzbearbeitungschinen GmbH, Ichenhausen (DE)

( * ) Notice: Subject to any disclaimer, the term of this patent is extended or adjusted under 35 U.S.C. 154(b) by 4 days.

(21) Appl. No.: 12/232,923

(22) Filed: Sep. 26, 2008

(65) Prior Publication Data

US 2009/0050237 A1 Feb. 26, 2009

(51) Int. Cl.
*B27L 7/06* (2006.01)

(52) U.S. Cl. ..... 144/4.6; 144/193.2; 144/195.8

(58) Field of Classification Search ..... 144/193.1, 144/193.2, 195.8, 195.1, 195.7, 4.6
See application file for complete search history.

(56) References Cited

U.S. PATENT DOCUMENTS

| | | | | |
|---|---|---|---|---|
| 3,862,651 | A * | 1/1975 | Heikkinen | 144/4.6 |
| 4,353,401 | A * | 10/1982 | Schilling | 144/195.1 |
| 4,461,331 | A | 7/1984 | Mertz | |
| 4,515,194 | A * | 5/1985 | Dankel | 144/195.1 |
| 4,800,937 | A * | 1/1989 | Mangus, Sr. | 144/195.1 |
| 4,860,806 | A * | 8/1989 | Brace | 144/195.8 |
| 5,337,810 | A * | 8/1994 | McCormack | 144/195.1 |
| 5,711,357 | A | 1/1998 | Smith | |
| 7,104,295 | B2 * | 9/2006 | Heikkinen et al. | 144/193.1 |
| 7,108,029 | B2 * | 9/2006 | Albright | 144/193.2 |

FOREIGN PATENT DOCUMENTS

| | | | |
|---|---|---|---|
| DE | 103 02 906 | A1 | 8/2004 |
| EP | 0 664 190 | A1 | 7/1995 |
| EP | 1 837 147 | B1 | 9/2007 |
| WO | WO 2005/095072 | A1 | 10/2005 |

* cited by examiner

*Primary Examiner* — Shelley Self
(74) *Attorney, Agent, or Firm* — Bacon & Thomas, PLLC

(57) ABSTRACT

In a wood splitter for splitting a log of wood into several pieces comprising a receiving chamber for the log of wood which is limited by a stand arranged parallel to the axis of the log of wood, and transverse to the stand and relative thereto, is further limited by limit stops projecting in a direction normal to the said axis of the stand, with at least one limit stop being movable in the direction of the axis and at least one limit stop being designed as a splitting unit a high degree of user-friendliness and a rational method of operation may be achieved in that a splitting wedge designed in the manner of an insert pin held only in the area of the base thereof is associated with the end of the receiving chamber, which splitting wedge can accommodate a splitting insert comprising an insertion pocket which can be inserted into the insert pin, and further a set of tools attached to the insertion pocket containing several splitting wedges which are arranged according to a desired pattern of pieces resembling the blossoms of a tulip.

10 Claims, 5 Drawing Sheets

WOOD SPLITTER

TECHNICAL FIELD

This invention relates to a wood splitter for splitting a log of wood into several pieces, comprising a receiving chamber for the log of wood, which chamber is limited by a stand arranged parallel to the axis of the log of wood, and transverse to the stand and relative thereto, is further limited by limit stops projecting in a direction normal to the said axis of the stand, with at least one limit stop being movable in the direction of the axis and at least one limit stop being designed as a splitting unit.

BACKGROUND DISCUSSION

On known arrangements of this kind (for example DE 103 02 906 A1) one limit stop is formed by a stationary splitting wedge unit. In order to obtain a variation of different patterns of the pieces, the splitting wedge unit has to be removed and replaced by another unit. Varying the patterns thus proves to be difficult and time consuming. In practice, however, the pattern of the pieces needs to be frequently changed, for example in the case when a relatively thick log of wood first has to be split into two parts and when each of those large pieces are then split into four or six relatively small pieces. Replacing the splitting wedge unit of the known arrangement is thus very difficult and time consuming. Therefore, such an arrangement is not considered sufficiently user-friendly and efficient.

SUMMARY OF THE INVENTION

On these premises it is the object of the present invention to improve an arrangement as described initially above in such a way that a high degree of user-friendliness and efficiency is achieved.

According to the invention, this object is achieved in that a splitting wedge designed in the manner of an insert pin held only in the area of the base thereof is associated with the wedge-unit end of the receiving chamber, which splitting wedge can accommodate a splitting insert comprising an insertion pocket which can be inserted into the insert pin, and further a set of tools attached to the insertion pocket containing several splitting wedges which are arranged in a certain desirable pattern of the pieces.

These measures in an advantageous manner permit a rapid variation of the pattern of split off pieces. For this purpose the movable splitting insert simply has to be put on or removed, as the case may be. In the case where only a middle splitting wedge is required for splitting a large log of wood into two pieces, the splitting insert is simply be removed. In order to obtain relatively small pieces, i.e. what is referred to as kindling wood, the splitting insert is inserted into the insert pin. Such insertion and/or removal operation only requires a small amount of time, so that only insignificantly short interruptions of the operation are required.

The splitting insert may advantageously be designed in such a way that a log of wood is split several times along its middle and along its sides. For this purpose the set of tools comprises a main splitting wedge which is coplanar to the splitting wedge acting as an insert pin, which main splitting wedge is flanked on either side by several ancillary splitting wedges standing out sideways which extend radially inwards while being inclined towards the base frame member.

These measures, in an advantageous manner, result in a pattern of pieces similar to the blossoms of a tulip, which is particularly suitable to produce comparatively thin pieces fit for kindling fire. Since the ancillary splitting wedges extend inwards while being inclined towards the base frame, the pattern of the pieces in an advantageous manner opens on the side away from the base frame, so that the pieces thus obtained are not jammed and can reliably tilt away towards the outside. A further advantage lies in the fact that the wedge may have a relatively large thickness. This circumstance, on the other hand, permits a comparatively small length of the ancillary wedges extending in a radial direction which supports an independent tilting away of the split off pieces towards the outside.

A further advantageous measure may consist in that the angle of inclination of the ancillary splitting wedges increases with growing distance from the base frame. This circumstance even increases the advantage described above with regard to the absence of a risk of jamming and an unimpeded tilting away of the split off pieces towards the side.

Advantageously, the main splitting wedge as compared to the ancillary wedges may have a greater length in an axial direction and may protrude further towards the log of wood. Likewise, the main splitting wedge expediently possesses a greater thickness than the ancillary wedges. Due to the main splitting wedge, the split of pieces formed by the ancillary wedges are urged into a radially outward direction, thus facilitating the tilting off of the split off pieces towards the side.

Expediently, the ancillary splitting wedges may be attached to the main splitting wedge which in turn is mounted on the insertion pocket. The insertion pocket may advantageously serve as an extension of the main splitting wedge, so that the split off pieces of wood formed by the ancillary splitting wedges are reliably urged into an outward direction.

Advantageously, the insertion pocket may have a triangular form possessing a triangular internal cross section. The splitting wedge acting as an insert pin expediently has a configuration derived from a triangle and can be inserted into the insertion pocket with a certain amount of sliding clearance. Of particular advantage is the circumstance that the lateral flanks of the insert pin may be concavely curved towards the inside, which results in a linear contact along the inner side of the insertion pocket. Due to such triangular contact, the inserted splitting wedge can independently align itself in an exact manner.

BRIEF DESCRIPTION OF THE DRAWINGS

Further advantageous embodiments and expedient developments will be evident from the remaining sub-claims and will be evident from the description of an example given below in conjunction with the accompanying drawings wherein—

DETAILED DISCUSSION IN CONJUNCTION WITH THE DRAWINGS

Figure 1:
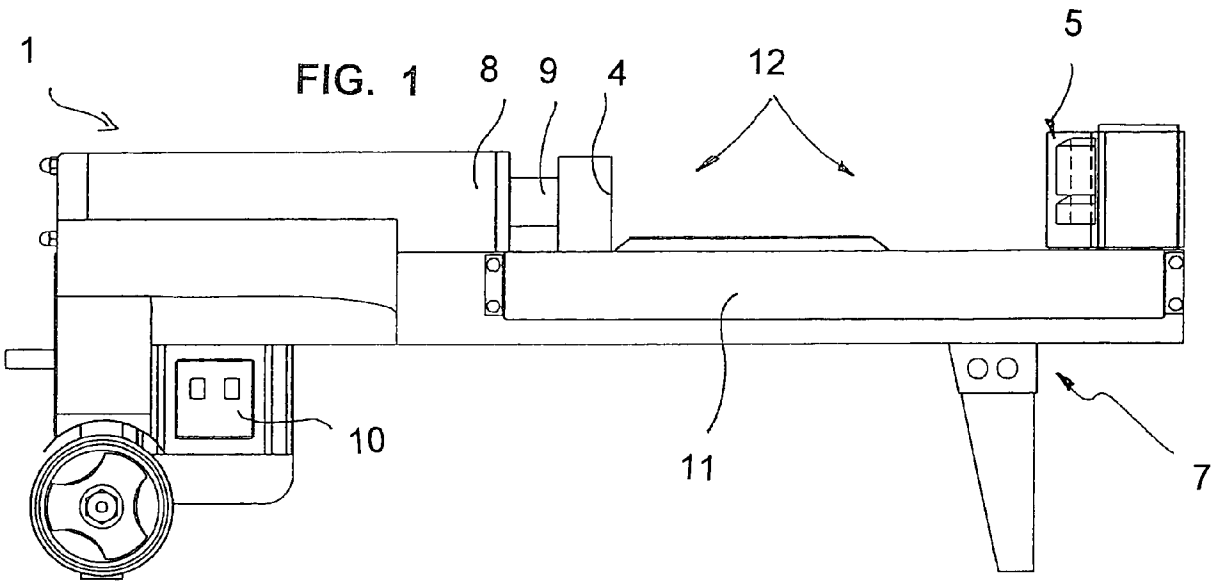
FIG. 1 shows a lateral view of a wood splitter in a horizontal position according to an embodiment of the invention.
Figure 2:
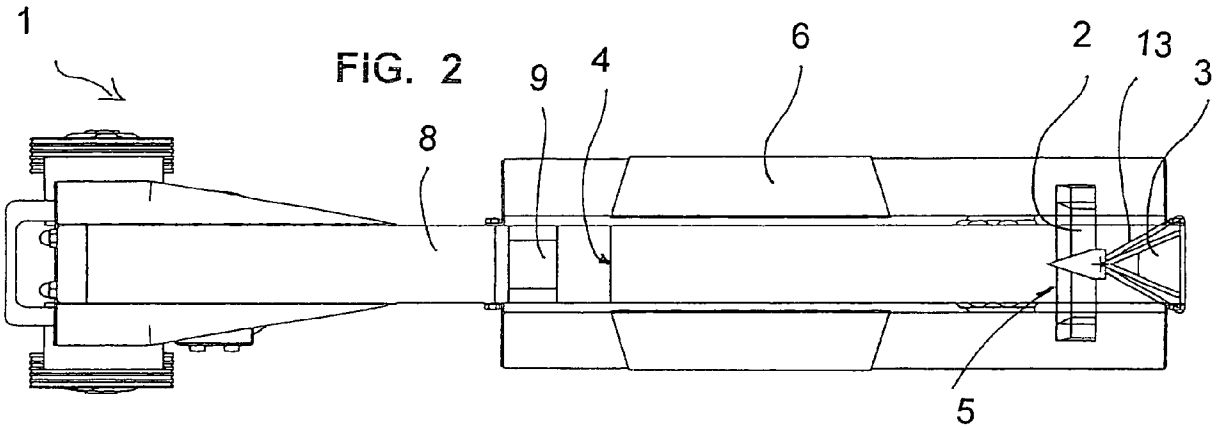
FIG. 2 shows a top view of the arrangement according to FIG. 1.

The horizontal wood splitter 1 shown in the FIGS. 1 and 2 possesses a machine frame 7 designed as a movable base unit. Such base unit comprises a longitudinal beam 11 which on one side is supported on legs and on the other side on rollers. The beam 11 possesses a level upper side which may be extended by lateral plates thus forming a support face 6. On part of the length of the support face 6 plate sections arranged in V-shape relative to one another may be provided in the area of the lateral extension for the formation of a groove. The support face 6 serves to accommodate a horizontal piece of wood, for example a section of a log. At the longitudinal ends of the support face 6 provision is made for limit stops 4, 5 limiting a receiving chamber 12 for each piece of wood to be split and projecting in a direction normal to the frame side beam 11. The logs of wood to be split may, for example, either be transported to the machine by means of conveyor belts or be placed thereon by hand, in a manner that is generally known to the art.

In the example illustrated, the limit stop 4 is designed as a ram plate which is provided at the end of a hydraulic piston 9 which in turn is movably housed in a hydraulic cylinder 8 accommodated on machine frame, i.e. said hydraulic piston 9 can be moved in an axial direction towards the log of wood and away from it. Associated with the hydraulic cylinder 8 is a hydraulic pump which is drivable by an electric motor 10. Likewise conceivable are other kinds of drive, for example a combustion machine or the like. The limit stop 5 is designed as a splitting unit. In the example shown, such splitting unit is provided on the machine frame as a stationary member. It would, of course, likewise be possible to provide the ram plate as a stationary member and the splitting tool as a movable part.

For the formation of the limit stop 5, as is evident from FIG. 2, provision is made for a splitting wedge 3 which projects vertically upwards from the support face 6 of the machine frame, on which splitting wedge 3 a splitting insert 2 may selectively be mounted. In the FIGS. 1 and 2 the splitting insert 2 is mounted on the splitting wedge 3. In the FIGS. 3 and 4 the splitting insert 2 has been removed.

Figure 3:
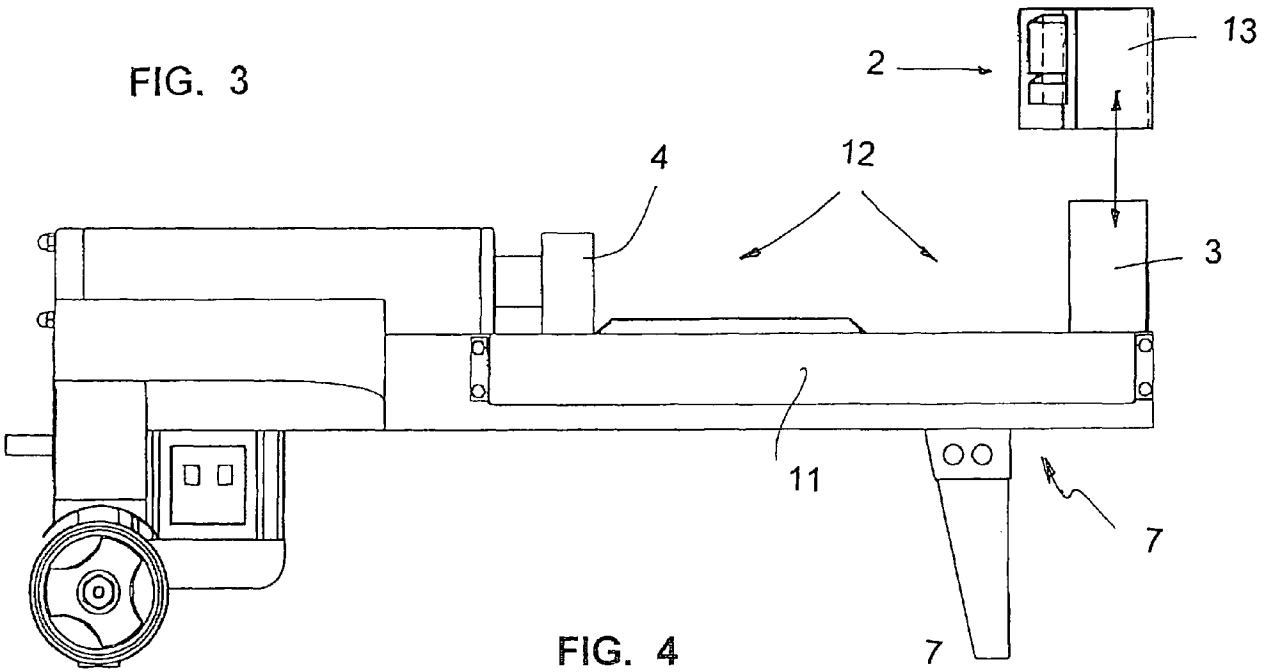
FIG. 3 shows a lateral view of the arrangement according to FIG. 1 with splitting insert removed.

The splitting insert 2 is designed as an insert unit. The splitting wedge 3 accommodating the splitting insert 2, as can best be seen from FIG. 3, is designed in a manner similar to an insert pin which only in the area of its base is attached to the frame, while its opposite end is clear, so that the splitting insert 2, as is indicated by a double arrow, can be mounted on the splitting wedge 3 from the top or removed towards the top. The insertion depth is limited by the splitting insert 2 which, with its lower edge, abuts on the upper side of the frame. Due to gravity the splitting insert 2 is reliably held in engagement with the splitting wedge 3 acting as an insert pin. An additional securing means is thus not required.

Figure 4:
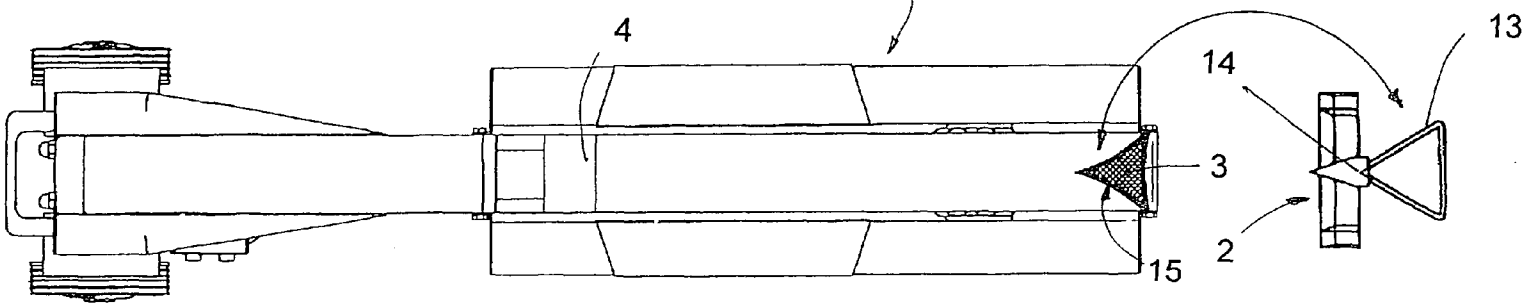
FIG. 4 shows a top view of the arrangement according to FIG. 2, with the removed splitting insert shown in a laterally displaced position.

The splitting insert 2, as can best be seen from the FIGS. 2 and 4, comprises an insertion rear pocket 13 which can be inserted into the splitting wedge 3 acting as an insert pin, and further a set of tools attached to the side of the receiving chamber and containing several splitting wedges which are arranged according to a desirable pattern of split off pieces of wood. The splitting wedge 3 acting as an insert pin expediently possesses a triangular form or an outer configuration derived from a triangle and is symmetrical relative to a mid longitudinal plane of the frame. The insertion pocket 13 possesses a correspondingly triangular internal cross-section, so that a fitting, mutual insert engagement is ensured. It goes without saying that sufficient sliding clearance should be provided. Advantageously, the insertion pocket 13 likewise possesses a triangular and thus wedge-shaped external contour. In the embodiment underlying FIG. 2 the external contour of the triangle-shaped splitting wedge 3 is somewhat slimmer than the inner configuration of the insertion pocket 13. The splitting wedge 3, in order to be aligned, may with its rear side abut on the rear side of the insertion pocket 13. For receiving the front edge of the splitting wedge 3 a suitable notch or groove may be provided on the rear side of the set of blades attached to the rear side of the insertion pocket 13, as it is indicated by reference numeral 14 in FIG. 4.

Figure 5:
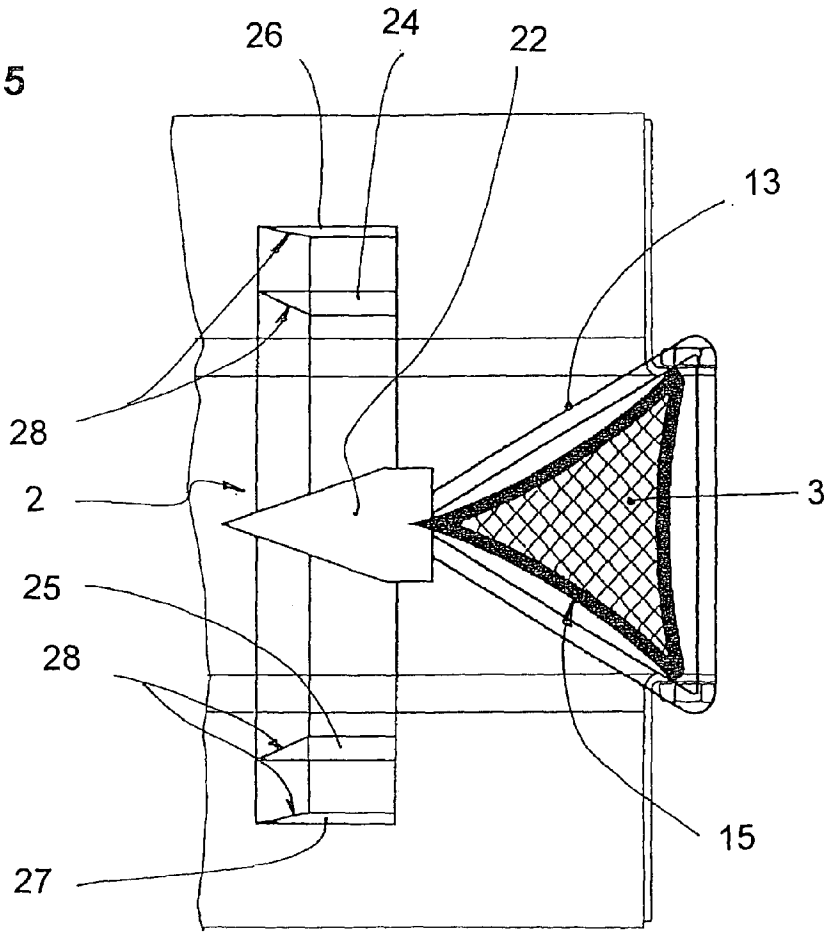
FIG. 5 shows an enlarged top view of the splitting insert inserted into the splitting wedge acting as an insert pin.

The splitting wedge 3 acting as an insert pin may in an advantageous manner be provided with lateral flanks 15 adjacent to its cutting edge which are concavely curved towards the inside, as can best be seen from the FIGS. 4 and 5. In this way, linear contact is obtained along the rear outside edges as well as at the cutting edge, thus likewise ensuring an exact symmetrical alignment of the splitting wedge 2 relative to the mid longitudinal plane. The rear limit of the insertion pocket 13 may thus get in contact at the rear end of the splitting wedge 3, or as is evident from the example shown, may be at a certain distance therefrom, which results in sufficient sliding clearance. The splitting wedge 2 will align itself automatically when a certain load is put on it in an axial direction. The rear side of the splitting wedge 3 may either be straight or, as shown in the example, may likewise be concavely curved towards the inside.

The set of tools attached to the insertion pocket 13, as is further evident from FIG. 5, comprises a middle main splitting wedge 22 which is coplanar to the splitting wedge 3, that is to say placed directly in front of it, and extends vertical to the support face 6, and several ancillary splitting wedges 24, 25, 26, 27, arranged in four pairs and standing out sideways from the main splitting wedge 22. On either side of the main splitting wedge 22 provision is made for two ancillary splitting wedges arranged one above the other. The ancillary splitting wedges 24 to 27 are with their radially inner ends attached to the main splitting wedge 22, expediently welded thereon, while the rear side of the said main splitting wedge is attached to the insertion pocket 13, likewise expediently welded thereon, in such a manner that the groove 14 associated with the cutting edge of the splitting wedge 3 may be cut into the rear side of the main splitting wedge 22.

The main splitting wedge 22 is longer in an axial direction than the ancillary splitting wedges 24 to 27 and its cutting edge projects beyond the cutting edges of the said ancillary splitting wedges. The latter may accordingly be welded onto the main splitting wedge 22 along their entire axial width. The projection of the main splitting wedge 22 in an advantageous manner results in a slightly earlier splitting action by which circumstance the pieces of wood thus split off are urged into a radially outward direction. The main splitting wedge 22 is likewise thicker than the ancillary splitting wedges 24 to 27 which enhances the advantage stated above. The triangular insertion pocket 13 practically forms a rear extension of the main splitting wedge 22, which likewise urges the pieces of wood thus split off into an outward direction. The main splitting wedge 22 possesses a cutting edge of a triangular configuration which is symmetrical to the mid longitudinal plane. The ancillary splitting wedges possess cutting edges of an asymmetrical configuration which are bevelled to a chamfer 28 inclined in a rearward direction away from the frame and formed by a grinding operation.

Figure 7:
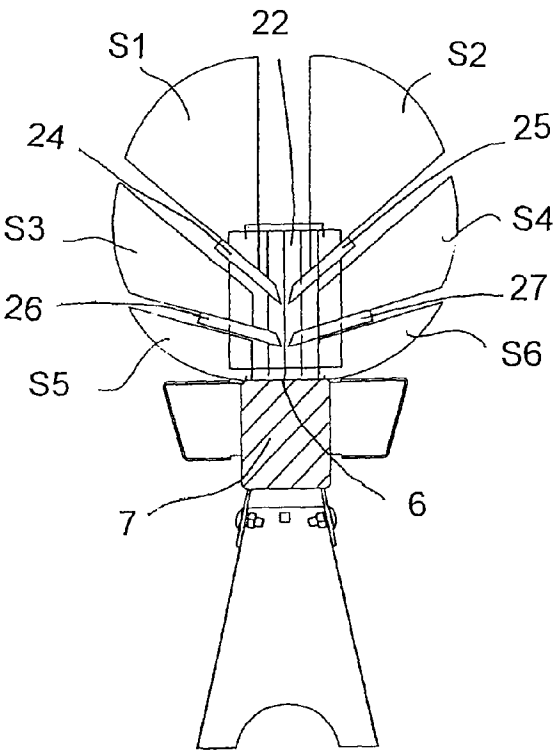
FIG. 7 shows a sectional view of FIG. 6 where the limit stops have reached an end position and with the split pieces of wood formed from the log of wood.
Figure 6:
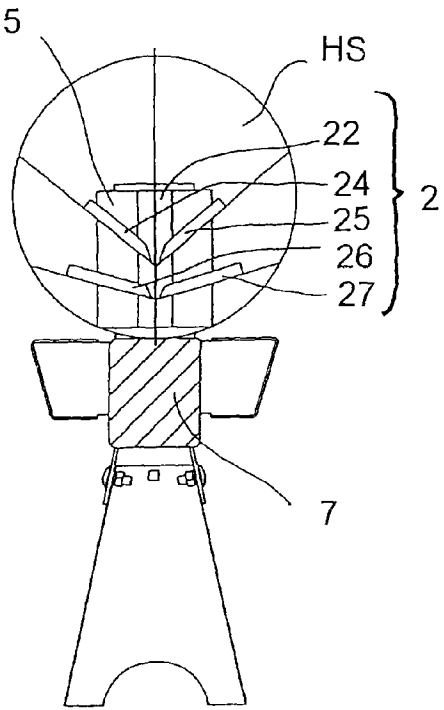
FIG. 6 shows a sectional view along the line VI-VI in FIG. 1 with a schematically drawn log of wood.

The arrangement of the ancillary splitting wedges 24 to 27 can best be seen from the FIGS. 6 and 7. In order to explain their function, a log of wood HS is drawn in FIG. 6 and the split off pieces of wood S1, S2, S3, S4, S5 and S6 thus obtained are shown in FIG. 7. The ancillary splitting wedges 24 to 27 flanking the main splitting wedge 22 extend in an inward direction, that is to say towards the main splitting wedge 22 with a downward inclination, that is to say towards the frame-side support face 6. The angle of inclination increases with a growing distance from the frame, that is to say the top ancillary splitting wedges 24, 25 have a greater inclination than the ancillary splitting wedges 26, 27 below. Expediently, the two ancillary splitting wedges 26, 27 near the frame may be inclined at an angle of at least 8 degrees, preferably more than 12 degrees, relative to a plane which is transverse to the longitudinal mid plane. The ancillary splitting wedges 24, 25 away from the frame may expediently be inclined at an angle of at least 30 degrees, preferably more than 40 degrees, relative to such plane.

As soon as the log of wood HS is pushed against the splitting insert 2 by means of the cylinder-piston unit 8, 9 the splitting wedges 22 and 24 to 27 with their cutting edges cut into the log of wood, which, corresponding to the arrangement of the splitting wedges, results in a pattern of the split off pieces resembling the blossoms of a tulip. As the hydraulic piston 9 moves further in the direction of the splitting insert 2 until it reaches the end position shown in FIG. 7 the splitting wedges 22 and 24 to 27 further cut into the log of wood and split the said log of wood into the individual split off pieces S1 to S6.

The two upper pieces of wood, i.e. the pieces S1, S2 which are farthest away from the support face 6 have the form that will normally be obtained when using a regular six-edge splitting tool, while the form of the middle pieces S3, S4 and the lower pieces S5, S6 contacting the support face 6 deviate from such normal form, since the ancillary splitting wedges 24, 25 and 26, 27 extend from the mid longitudinal plane in an upward and outward direction. The split off pieces S1 to S6 obtained by the splitting operation are urged radially outwards by the main splitting wedge 22 and, if necessary, by the insertion pocket 13 forming a rear extension of the main splitting wedge 22. After the splitting of the lower pieces S5, S6 they come to rest on the support face 6 with only their lowest inner longitudinal edge, which, due to their own weight, results in a tilting moment causing the said pieces S5, S6 to tilt towards the outside, with the said inclination of the ancillary splitting wedges 26, 27 ensuring that the lowermost pieces S5, S6 are not jammed between the support face 6 and the lower ancillary splitting wedges 26, 27.

The thicker or wider the main splitting wedge 22 or its rear extension formed by the insertion pocket 13, the more are the split off pieces of wood S1 to S6 urged in a radially outward direction. Since the lower ancillary splitting wedges 26, 27 are inclined relative to the support face 6 and the upper ancillary splitting wedges 24, 25 in turn are inclined relative to the ancillary splitting wedges 26, 27 serving as a support for the pieces S3, S4, the split off pieces S3, S4 and S5, S6, respectively, contacted by the ancillary splitting wedges get clear during a radial movement from the ancillary splitting wedges contacting them, as can be seen from FIG. 7.

As has been stated above, the lower pieces S5, S6, due to their own weight, tilt off over the lateral edges of the support face 6. The radial extension, that is to say, the length of the ancillary splitting wedges 24 to 27 is relatively small as compared to the diameter of the log of wood HS to be split. In the projection shown in the drawing the ancillary splitting wedges 24 to 27 are located within the support face 6. Due to the relatively short length of the ancillary splitting wedges 26, 27, the middle pieces S3, S4 are likewise subjected to a tilting moment, causing them to tilt off in a radially outward direction from their position on the lower ancillary splitting wedges 26, 27. The same likewise applies to the two upper pieces S1, S2 whose centre of gravity likewise lies beyond the external edge of the upper ancillary splitting wedges 24, 25 accommodating the said pieces S1, S2, so that they can correspondingly tilt off outwards.

Figure 8:
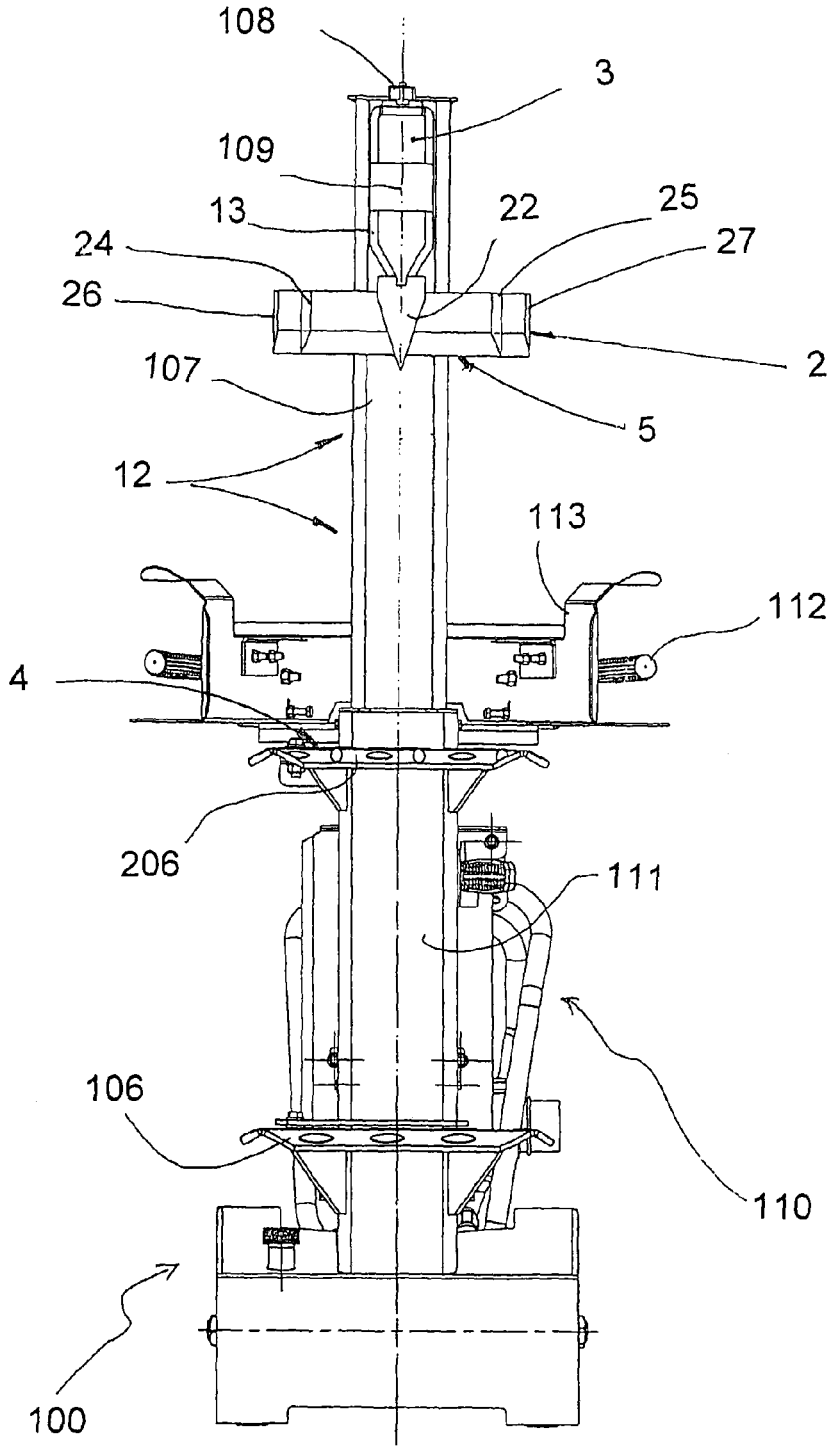
FIG. 8 shows a front view of a wood splitter in vertical position as proposed by an embodiment of the invention.

The FIGS. 1 to 7 are based on a horizontal wood splitter. The invention can likewise be applied to a vertical wood splitter. Such an arrangement is shown in FIG. 8. The vertical wood splitter, in toto designated by the numeral 100, comprises a bottom table 106 attached to a column 111 which projects from a stand in an upward direction and forms a horizontal support area for the vertical accommodation of logs of wood. Above the said support area provision is made for a further insert table 206 which may serve to accommodate relatively short logs of wood but is removed when long logs of wood to be worked are placed on the lower table 106. The column 111 accommodates a beam 107 which is movable along the vertical axis. Drive is provided by a hydraulic unit, in toto designed by the numeral 110. In the area of the upper end of the beam 107 provision is made for a splitting unit.

The splitting unit and the activated table 106 or 206 arranged below form limit stops 4 and 5, respectively, limiting a receiving chamber 12, with the limit stop 4 formed by the table being stationary and the limit stop 5 formed by the splitting unit being movable in an upward and downward direction. For the formation of the splitting unit forming the movable limit stop 5 provision is made in turn for a splitting wedge 3 serving as an insert pin on which a splitting insert 2 can be mounted. In this arrangement the splitting wedge 3 acting as an insert pin is arranged horizontally, that is to say the splitting wedge 3 projects in a direction perpendicular to the beam 107. The splitting insert 3 in turn comprises a rear insertion pocket 13 which is attachable to the splitting wedge 3 acting as an insert pin. Since in this arrangement the gravity does not act in the direction of insertion, a securing device preventing sliding movement is expediently provided. In the example illustrated, provision is made for an upper, middle clamping screw 108. To restrict the insert depth a limit stop may be provided. Such limit stop, as shown in the example illustrated, is designed as a retaining member 109 bridging the rear end of the insertion pocket 13.

The design and the function of the splitting insert 2 are identical to the design and function of the previously mentioned horizontal wood splitter, so that, to avoid repetitions, reference is made to the embodiments in respect thereof. In this arrangement, the splitting insert 2 likewise comprises a middle main splitting wedge projecting in splitting direction from which the four ancillary splitting wedges 23 to 27 stand out, so that a desired pattern of the split off pieces of wood is obtained which resembles the blossom of a tulip.

To move the splitting unit forming the limit stop 105 with or without a splitting insert, provision is made for a two-hand control device attached to a control board 113 which can be actuated via two handles 112.

It goes without saying that deviations from the embodiments shown are possible without leaving the basic idea of the invention.

The invention claimed is:

1. A wood splitter for splitting a log of wood into several pieces comprising:

a receiving chamber for the log of wood;

a stand which engages and limits said receiving chamber, said receiving chamber being arranged parallel to the axis of the log of wood, and transverse to said stand and relative thereto, is further limited by limit stops projecting from said stand in a direction normal to the axis of said stand, with at least one limit stop being movable in the direction of the axis and at least one limit stop being a splitting unit, said limit stops forming ends of said receiving chamber, said splitting unit including a first splitting wedge and a splitting insert, which splitting insert comprises a pocket arranged to be inserted over said first splitting wedge to change a splitting pattern of said wood splitter, said first splitting wedge serving as a splitting tool when used without said splitting insert, and as a pin support when said pocket of said splitting insert is fitted over said first splitting wedge; and a set of tools attached to said pocket and containing several splitting wedges extending axially from said pocket to split said log into multiple pieces as said movable limit stop is moved in said axial direction.

2. A wood splitter in accordance with claim 1, wherein:

said set of tools comprises a main splitting wedge which is coplanar to said first splitting wedge, which main splitting wedge is flanked on either side by several ancillary splitting wedges which are arranged in several pairs on top of one another and extend radially inwards while inclining towards the stand.

3. A wood splitter in accordance with claim 2, wherein:

said stand comprises a base frame member;

an angle of inclination of said ancillary splitting wedges increases with increasing distance from said stand, with two said ancillary splitting wedges near said base frame member being inclined at an angle of at least 8 degrees relative to a plane which is transverse to a longitudinal mid plane of said main splitting wedge, while additional said ancillary splitting wedges that are away from the stand are inclined at an angle of at least 30 degrees relative to such plane.

4. A wood splitter in accordance with claim 2, wherein:

said main splitting wedge protrudes towards the log of wood as compared to said lateral ancillary splitting wedges and is thicker than said lateral splitting wedges.

5. A wood splitter in accordance with claim 2, wherein:

said ancillary splitting wedges projecting from said main splitting wedge are attached to said main splitting wedge which is mounted to said pocket.

6. A wood splitter in accordance with claim 2, wherein:

said stand comprises a base frame member;

said first splitting wedge and said main splitting wedge of said splitting insert are each fitted with a cutting edge which is symmetrical relative to a mid longitudinal plane of the wood splitter; and said ancillary splitting wedges each includes a cutting edges inclined away from said base frame member.

7. A wood splitter in accordance with claim 2, wherein:

said pocket has a triangular form serving as an extension of said main splitting wedge and said first splitting wedge likewise has a triangular form, with at least lateral flanks thereof being of concave configuration.

8. A wood splitter in accordance with claim 1, wherein:

said splitting insert mounted on said first splitting wedge is secured against sliding movement by a securing device and is provided with a limit stop which is a retaining member bridging the rear end of said pocket.

9. A wood splitter in accordance with claim 1, wherein:

said stand is a horizontal beam resting on a support with the limit stop of said receiving chamber that is a splitting unit being arranged as a non movable unit.

10. A wood splitter in accordance with claim 1, wherein:

said stand includes a vertical column with an extendable and retractable beam, with the bottom limit stop being a stationary table and the upper limit stop being a splitting unit attached to the extendable and retractable beam.

* * * * *